United States Patent [19]

Paczuski

[11] 4,111,612

[45] Sep. 5, 1978

[54] HERMETIC COMPRESSOR LUBRICATION SYSTEM

[75] Inventor: Andrew Waclaw Paczuski, Bristol, Tenn.

[73] Assignee: Sundstrand Corporation, Rockford, Ill.

[21] Appl. No.: 785,713

[22] Filed: Apr. 7, 1977

[51] Int. Cl.[2] ..... F04B 17/00; F04B 39/02

[52] U.S. Cl. ..... 417/372; 417/902; 184/6.16

[58] Field of Search ..... 184/6.16, 6.18, 6.24; 417/902, 372, 492; 415/88

[56] References Cited

U.S. PATENT DOCUMENTS

| | | | |
|---|---|---|---|
| 3,098,604 | 7/1963 | Dubberley | 417/902 X |
| 3,162,360 | 12/1964 | Privon et al. | 417/372 |
| 3,253,776 | 5/1966 | Parker | 417/372 X |
| 3,259,307 | 7/1966 | Ayling | 417/372 |
| 3,285,504 | 11/1966 | Smith | 417/372 |
| 3,311,292 | 3/1967 | Connor | 417/372 X |
| 3,334,808 | 8/1967 | Parker et al. | 417/902 X |
| 3,674,382 | 7/1972 | Kubota et al. | 417/372 |
| 3,736,076 | 5/1973 | Ayling | 417/372 |

*Primary Examiner*—David H. Brown

*Attorney, Agent, or Firm*—Ted E. Killingsworth; William R. Peoples; Michael B. McMurry

[57] ABSTRACT

A hermetic refrigerant compressor includes an electric motor mounted within a sealed housing with a crankshaft extending vertically from the motor to connect with a plurality of compressor pistons. The lower end portion of the crankshaft extends into a sump of lubricant in the housing and a pump is formed in the lower end of the crankshaft to pump lubricant through a discharge conduit to an annular chamber located within an upper bearing support for the crankshaft. The discharge conduit is offset from the central axis of the crankshaft and a diametrical cross-bore including first and second radial segments communicates with the annular chamber, the cross-bore intersecting the upper end of the discharge conduit. From the discharge conduit, one segment of the cross-bore is longer than the other so that lubricant is slung radially outward through the shorter length segment into the annular chamber. Refrigerant gases in the annular chamber are driven toward the end of the longer segment of the cross-bore by the centrifugal force of rotating shaft and then back through the longer segment by excess flow of lubricant to a venting duct which communicates from the center of the crankshaft to the interior of the housing below the upper bearings.

6 Claims, 4 Drawing Figures

HERMETIC COMPRESSOR LUBRICATION SYSTEM

BACKGROUND OF THE INVENTION

The present invention relates generally to a hermetic refrigerant compressor such as may be driven by an electric motor supported within a hermetically sealed housing. More particularly, the invention relates to a lubrication system for such compressor wherein advantage is taken of the rotation of a shaft driven by the motor for lubricating parts of the compressor. Typically, for a lubrication system of this type, the compressor motor is oriented so the driven shaft extends vertically downward with the lower end portion of the shaft being immersed in a sump of lubricant collected in the lower section of the housing. With the lower end portion of the shaft constructed as a pump impeller to form a lubricant pumping means, when the motor is running, lubricant may be pumped upwardly through the system to lubricate between the parts of the compressor which are moving relative to each other.

In prior art hermetic refrigerant compressors, such as those disclosed in U.S. Pat. No. 3,584,980 and in U.S. Pat. No. 3,926,281, the lower end portion of the driven shaft may be adapted to function as a two-stage pump. One reason for using two-stage pumping is to develop sufficient flow and pressure in the discharged lubricant for lubricating the less accessible upper parts of the compressor. This is particularly important in a multiple-speed compressor which is powered by an electric motor that is adapted to be switched selectively between two-pole and four-pole operating modes according to the speed desired for operation of the compressor. With the motor operating in its two-pole mode, its speed is, of course, twice that of when operating in its four-pole mode. Accordingly, the quantity of lubricant and the pressure within the lubricant being pumped by the rotating shaft is substantially different for the two modes of operation.

Even with the increased flow and pressures provided by two-stage pumping, difficulty may be encountered in obtaining adequate lubrication of the support bearings for the motor. This is because some of the refrigerant used in the compressor is naturally absorbed in the lubricant and, as the lubricant is pumped through the system, the absorbed refrigerant tends to flash or boil out of the lubricant as lubricant pressure decreases and/or the temperature increases. Undesirably, the flashed refrigerant gases may collect within the passages of the lubricating system, creating a pressure barrier to the adequate flow of lubricant to the working parts of the compressor. This is particularly true at the upper support bearings for the motor shaft because of the increase in the temperature of the lubricant and the loss of pressure as the lubricant is pumped through a discharge conduit leading upwardly toward the motor and into an annular chamber from which the upper bearing surfaces are lubricated.

SUMMARY OF THE INVENTION

The primary object of the present invention is to provide a new and simplified arrangement for supplying lubricant to the upper support bearings of the compressor while at the same time venting the annular chamber adjacent the bearings to keep flashing refrigerant gases from blocking the flow of lubricant between the driven shaft and the upper bearings. A more detailed object is to achieve the foregoing by utilizing the same passage both for delivering lubricant to the annular chamber and for venting flashed refrigerant gases from the chamber.

More particularly, the invention resides in constructing this combined supply and venting passage as a single, diametrical, cross-bore extending completely through the shaft so that opposite ends of the cross-bore open into the chamber. Advantageously, with this arrangement, the discharge conduit from the lubricant pumping means intersects with the cross-bore off center of the shaft so that lubricant from the conduit is slung radially outward into the annular chamber, flowing essentially through only one shorter radial segment of the cross-bore, while refrigerant gases from the annular chamber are forced radially inwardly through the other longer radial segment of the cross-bore.

The invention also resides in the provision of a second passage communicating between the cross-bore and the interior of the housing from a position located generally at the center of the shaft to below the upper bearing support so lubricant vented with the refrigerant gases is directed toward working parts of the compressor for added lubrication of those parts.

Further still, the invention resides in the novel adaptation of the present lubrication system to a system employing a two-stage pump.

These and other objects and advantages of the present invention will become more apparent from the following detailed description when taken in conjunction with the accompanying drawings.

DETAILED DESCRIPTION OF PREFERRED EMBODIMENT

Figure 1:
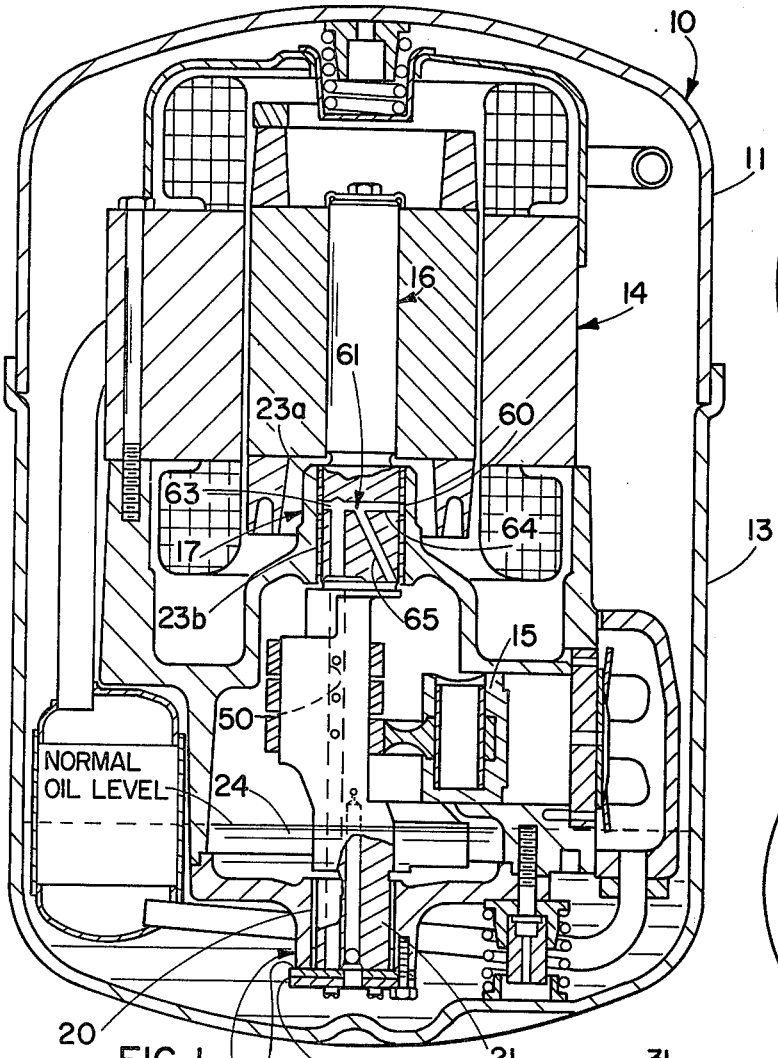
FIG. 1 is a cross-sectional view of a hermetic refrigerant compressor utilizing a lubrication system embodying the novel features of the present invention.

As shown in the drawings for purposes of illustration, the present invention is embodied in a lubrication system particularly suited for use in a hermetic refrigerant compressor 10. Herein, the compressor includes a housing having generally cylindrical upper and lower sections 11 and 13, respectively, and suitably mounted within the housing is an electric motor 14 which preferably is constructed for either two-pole or four-pole modes of operation. Refrigerant gas is returned to the interior of the housing through an inlet (not shown) from the return pipes of a refrigeration system (not shown). To compress the refrigerant gases, a plurality of compressor pistons 15 are located beneath the motor and are drivingly connected to the motor by way of a driven shaft in the form of a crankshaft 16. Accordingly, as the crankshaft is rotated by the motor, the compressor pistons are reciprocated to draw the refrigerant gases from the interior of the housing, compress those gases and then discharge the compressed gases into the refrigeration system for cooling.

Supporting the crankshaft 16 laterally above and below the compressor pistons 15 are upper and lower bearing supports 17 and 19, respectively. In the lower support 19, a bearing sleeve 20 is telescoped into the support and receives the lower end portion 21 of the crankshaft 16 and, in the upper support, upper and lower sections 23*a* and 23*b* of a bearing sleeve telescopically receive an intermediate section of the crankshaft. To support the crankshaft 16 in an axial direction, a thrust plate 18 is suitably secured to the lower bearing support beneath the lower end 21*a* of the crankshaft. Sandwiched between the thrust plate and the lower end of the crankshaft is a thrust washer or bearing plate 22 which is rotatably engaged by the lower end of the shaft on one side and by the thrust plate on the other side.

In the operation of the exemplary hermetic refrigerant compressor 10, it is necessary to provide lubricant between the bearing surfaces of the lower bearing sleeve 20 and the lower end portion 21 of the shaft 16, between the bearing surfaces of the upper sleeve 23 and the intermediate section of the crankshaft 16 and to other relatively moving parts of the compressor to avoid excessive wear between various parts of the compressor. A sump 24 of lubricant is provided in the lower section 13 of the housing with the lower end portion 21 of the crankshaft 16 extending into this sump. Herein, this end of the crankshaft is constructed in the form of pumping means operable to draw lubricant from the sump and to pump this lubricant through a discharge conduit 50 of the lubrication system to a chamber 60 defined by the annular space between the upper and lower sections 23*a* and 23*b* of the upper bearing sleeve 23. With this arrangement, a loss of lubricant pressure occurs as the lubricant flows upwardly through the conduit 50 in the crankshaft 16. Moreover, the temperature of the lubricant may be increased due to migration of heat from the motor 14 along the crankshaft 16. The cumulative affect of these two changes in condition of the lubricant may cause refrigerant gases trapped in the lubricant to boil or flash out of the lubricant at the upper end of the discharge conduit. In some instances, these gases may collect and block the flow of an adequate supply of the lubricant in between the bearing 23 and the crankshaft 16.

In accordance with the primary aspect of the present invention, provision is made of a new and simplified arrangement for supplying the lubricant to the annular chamber 60 while at the same time venting the chamber to keep refrigerant gases from blocking the flow of lubricant between the crankshaft 16 and the bearing surfaces of the upper bearing 23. For this purpose, the same passage is used both to deliver the lubricant to the chamber 60 from the discharge conduit 50 and to vent the chamber of the refrigerant gases. Use of the same passage for both supplying lubricant to the upper bearing surfaces and for the venting of gases simplifies the construction of the system for lubricating the upper bearing 23 and, by providing an arrangement for venting the chamber 60 of refrigerant gases, such gases are kept from blocking the flow of lubricant into the chamber.

In the present instance, the combined lubrication and venting passage is defined more specifically by a diametrical cross-bore 61 extending completely through the crankshaft 16 and intersecting with the discharge conduit 50 at a point within the shaft other than at the central axis of the shaft. In this way, the cross-bore 61 includes a shorter radial segment 63 extending from its intersection with the discharge conduit 50 radially outward to the annular chamber 60. A longer radial segment 64 of the bore extends in the other direction from the discharge conduit, through the central axis of the crankshaft and also opens into the annular chamber 60. Advantageously, this particular construction utilizes the natural centrifugal forces generated in the rotating shaft to sling the heavier lubricant outwardly through the shorter radial segment 63 and into the annular chamber 60. On the other hand, at least to some extent, the lighter refrigerant gases in the upper end of the conduit 50 tend to migrate radially inward relative to lubricant flow. Furthermore, as the lubricant enters the chamber, any refrigerant gases in the chamber 60 are forced in a circumferential direction away from the outlet of the shorter segment and toward the opposite end opening of the longer segment 64 of the cross-bore 61. Upon entering the longer segment of the cross-bore 61, the refrigerant gases are urged toward the center of the crankshaft 16. At the center of the crankshaft 16, a venting duct 65 intersects with the cross-bore to provide passage for directing the refrigerant gases back into the interior of the housing.

Preferably, the duct 65 is formed through the shaft 16 to slant downwardly and radially outward from its intersection with the cross-bore 61. Accordingly, the lower end of the duct 65 opens into the housing at the bottom of the upper bearing support 17 and above the compressor pistons 15. By virtue of this arrangement, any lubricant that may be vented through the passage 65 with the refrigerant gases is discharged into an area of the housing adjacent the connection between the compressor pistons and the crankshaft 16, thereby providing additional lubrication for these relatively moving parts.

Figure 2:
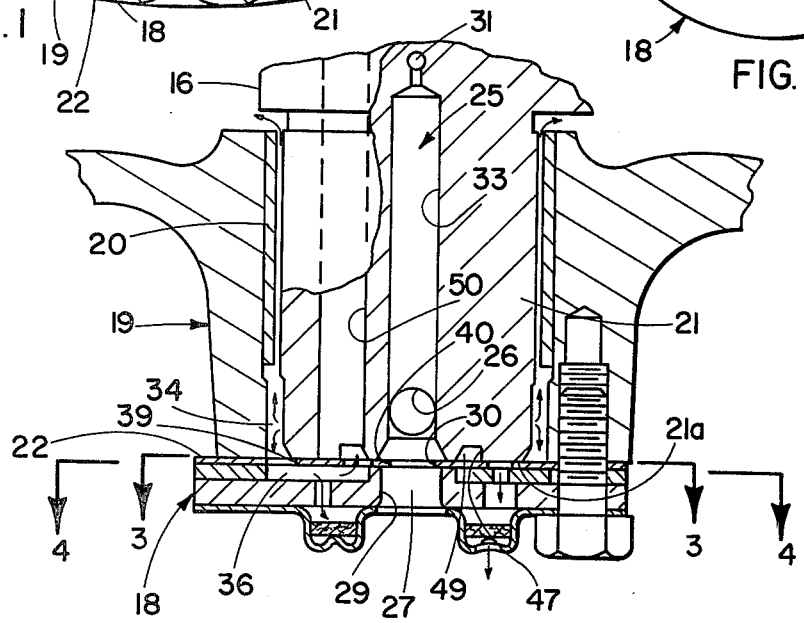
FIG. 2 is an enlarged cross-sectional view of a portion of the lower end of the driven shaft of the compressor motor and particularly illustrates a two-stage pump impeller as adapted for use in the exemplary lubrication system.

An additional advantage of the exemplary lubrication system is its unique adaptability for use in a system having as its primary means for pumping lubricant through the system either a single stage pump or a multiple stage pump, or any positive displacement pump. Herein, the exemplary form of the invention is employed in conjunction with a two-stage pumping means which is described with more particularity hereinafter. Thus, as shown in FIG. 2, the first stage pumping means includes a diametrical bore 26 formed in the lower end portion 21 of the crankshaft 16 to extend completely through the shaft. An axial inlet 27 to the first stage pumping means is defined by axial openings 29 and 30 which are formed in the thrust plate 18 and the bearing plate 22, respectively. When the compressor is operating, lubricant from the sump 24 is drawn upwardly through the inlet 27 and in an axial direction relative to the crankshaft 16 before being slung radially outward through the bore 26 as the shaft rotates.

Preferably, but not necessarily, the diameter of the opening 30 in the bearing plate 22 is smaller than the diameter of the opening 29 in the thrust plate 18. This construction thus provides a restriction within the inlet to the first pumping means. Accordingly, the lubricant flowing through the inlet is subjected to an abrupt and substantial drop in pressure prior to entering the bore 26. As a result of the drop in pressure caused by the restriction, refrigerant gases in the lubricant tend to flash from the lubricant in a confined area before the lubricant enters the bore 26. Advantageously, this tends to lessen the amount of refrigerant that may flash from the lubricant within the upper end of the discharge conduit 50.

To rid the first stage pumping means of the flashed refrigerant gases, a vent 25 communicates with the inlet 27 above the opening 30 and thus provides a passage by way of which the flashed refrigerant gases may escape from the lubrication system. Herein, the vent 25 includes a small diametrical passage 31 which intersects with the upper end of an axial bore 33 for venting refrigerant gases into the interior of the housing above the lower support 19 and above normal oil level. Thus, the gases are kept from collecting in the inlet area of the first stage pumping means to interfere with the flow of lubricant through the diametrical bore 26.

Figure 3:
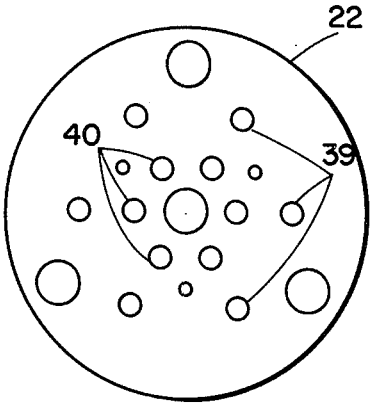
FIGS. 3 and 4 are enlarged views taken substantially along lines 3—3 and 4—4 of FIG. 2.
Figure 4:
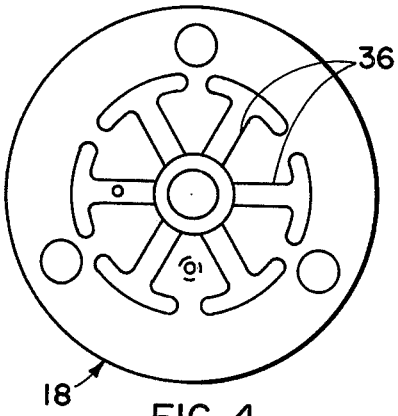

To provide lubricant between the lower bearing sleeve 20 and the crankshaft 16, lubricant is discharged from opposite ends of the diametrical bore 26 into an annular chamber 34. The annular chamber 34 is defined by the space between the lower bearing support 19 and the lower end portion 21 of the shaft 16 beneath the lower end of the bearing sleeve 20. Some of the lubricant discharged from the first stage pumping means flows upwardly toward the bearing sleeve 20 for lubrication of the surfaces between the bearing sleeve and the crankshaft 16. The remaining portion of the lubricant is directed downwardly through a first series of six angularly spaced apertures 39 in the bearing plate 22 and into six T-shaped passages 36. The latter are defined between the bearing plate 22 and the thrust plate 18 and extend between the annular chamber 34 and the second stage pumping means. Spaced radially inward of the first series of angularly spaced apertures 39 in the bearing plate 22 is a second series of six angularly spaced apertures 40 axially aligned with the radially inward ends of the T-shaped slots 36 of the thrust plate 18. As shown in FIG. 3, the apertures 39 and 40 are radially aligned with each other so that each radially aligned pair of apertures 39 and 40 is located at opposite ends of one of the T-shaped slots 36.

In providing lubricant for the second stage pumping means, the apertures 40 define an inlet to the second stage pumping means and, in the present instance, are spaced radially outward from the inlet 27 to the first stage pumping means. More particularly, the second stage pumping means comprises an annular groove 47 formed in the end face 21*a* of the crankshaft 16 concentrically with the central axis of the shaft. Herein, the groove, in part, is defined by a radially inward wall 49 having an inverted generally frustoconical shape. The upwardly and outwardly slanting wall 49 serves as a portion of the impeller of the second stage pumping means so that as the crankshaft 16 is rotated, lubricant flowing upwardly through the inlet apertures 40 is slung radially outward within the groove 47, thereby increasing the pressure of the lubricant. Intersecting with the groove 47 is the discharge bore 50 which extends in a generally axial direction from the lower end portion of the shaft 16 upwardly toward the upper bearing support 17 to provide a route for supplying lubricant to the chamber 60 between the bearing surfaces of the upper support sleeve sections 23*a* and 23*b* and the crankshaft 16.

In view of the foregoing, it will be appreciated that the present invention brings to the art a new and improved lubrication system particularly adapted for use in a hermetic refrigerant compressor 10. Herein, the lubrication system is provided with a unique arrangement for supplying lubricant to the upper bearing 23 and venting the chamber 60 through the same cross-bore 61. Advantageously, this is achieved by constructing the cross-bore to include radial segments 63 and 64 of different lengths from the discharge conduit 50 of the primary lubricant pumping means. By virtue of this arrangement, the shorter segment may be used to supply lubricant from the chamber while the longer segment serves as a vent for the chamber 60.

I claim:

1. In a hermetic refrigerant compressor including, a hermetically sealed housing, an electric motor mounted within said housing, a crankshaft connected to and depending from said motor to extend into a sump of lubricant within the housing, a bearing support in said housing and including a space defining a lubricant-receiving chamber for adjacent bearing surfaces within said support, means supported within said housing and drivingly connected with said crankshaft for compressing refrigerant gases from within said housing, the improvement in said compressor comprising a lubrication system for supplying lubricant to said chamber including, a cross-bore formed diametrically through said shaft and having first and second segments extending in generally opposite directions and communicating directly with said lubricant-receiving chamber, said first segment having a radial length shorter than the radial length of said second segment and an outlet opening into said lubricant-receiving chamber, said second segment having an inlet opening from said chamber, supply means within said shaft intersecting with said cross-bore between said first and second segments for supplying lubricant to said cross-bore, and a venting duct within said shaft communicating between the interior of said housing and said second segment intermediate the ends thereof so that, as said shaft is rotated, lubricant flows through said first segment and into said chamber whereby refrigerant gases in said chamber are driven by said lubricant away from the outlet of said first segment, into the inlet of said second segment and through said second segment to said venting duct for discharge into the interior of said housing.

2. In a hermetic refrigerant compressor including, a hermetically sealed housing, an electric motor mounted within said housing, a crankshaft connected to and depending from said motor to extend into a sump of lubricant within the housing, an upper bearing support in said housing and including upper and lower bearing sleeve sections, a lubricant-receiving chamber defined by the annular space between said sections, piston means supported within said housing and drivingly connected with said crankshaft for compressing refrigerant gases from within said housing, the improvement in said compressor comprising a lubrication system for supplying lubricant to said chamber including, pumping means associated with the lower end portion of said crankshaft, an inlet to said pumping means for admitting lubricant from said sump, a discharge conduit from said pumping means extending through said crankshaft in a generally longitudinal direction toward said upper bearing support, a cross-bore formed diametrically through said shaft adjacent said upper bearing support at the upper end of said discharge conduit and having first and second segments extending in generally opposite radial directions, said first segment having a radial length shorter than the radial length of said second segment and an outlet opening into said chamber, said second segment having an inlet opening from said chamber, said discharge conduit intersecting with said cross-bore between said first and second segments for supplying lubricant to said cross-bore, and a venting duct within said shaft communicating between the interior of said housing and said second segment intermediate the ends thereof so that, as shaft is rotated, lubricant flows through said first segment and into said chamber whereby refrigerant gases in said chamber are driven by said lubricant away from the outlet of said first segment, into the inlet of said second segment and through said second segment to said venting duct for discharge into the interior of said housing.

3. A lubrication system for a hermetic refrigerant compressor as defined by claim 2 wherein said discharge conduit is offset radially from the central axis of said crankshaft.

4. A lubrication system for a hermetic refrigerant compressor as defined by claim 3 wherein said pumping means includes first and second stage pumps, said inlet to said pumping means extending axially to said first stage pump, said second stage pump having an inlet spaced radially outward from the inlet to said first stage pump, said discharge conduit extending in a longitudinal direction upwardly from said second stage pump.

5. A lubrication system for a hermetic refrigerant compressor as defined by claim 3 wherein said venting duct intersects with said second segment of said cross-bore adjacent the central axis of said crankshaft.

6. A lubrication system for a hermetic refrigerant compressor as defined by claim 5 wherein said venting duct opens into the interior of said housing below said upper bearing support, said venting duct extending downwardly and outwardly from its intersection with the second segment of said cross-bore.

* * * * *